US010001067B2

(12) United States Patent
Tobinai

(10) Patent No.: US 10,001,067 B2
(45) Date of Patent: Jun. 19, 2018

(54) CARBURETOR WITH SCAVENGING FLUID FLOW

(71) Applicant: Walbro LLC, Tucson, AZ (US)

(72) Inventor: Teruhiko Tobinai, Sendai (JP)

(73) Assignee: WALBRO LLC, Tucson, AZ (US)

( * ) Notice: Subject to any disclaimer, the term of this patent is extended or adjusted under 35 U.S.C. 154(b) by 1 day.

(21) Appl. No.: 15/119,145

(22) PCT Filed: Feb. 26, 2015

(86) PCT No.: PCT/US2015/017750
§ 371 (c)(1),
(2) Date: Aug. 16, 2016

(87) PCT Pub. No.: WO2015/130932
PCT Pub. Date: Sep. 3, 2015

(65) Prior Publication Data

US 2017/0058788 A1 Mar. 2, 2017

Related U.S. Application Data

(60) Provisional application No. 61/946,458, filed on Feb. 28, 2014.

(51) Int. Cl.
*F02M 17/00* (2006.01)
*F02M 7/00* (2006.01)
(Continued)

(52) U.S. Cl.
CPC ..... *F02D 9/101* (2013.01); *F02M 1/02* (2013.01); *F02M 7/06* (2013.01); *F02M 7/12* (2013.01); *F02M 17/04* (2013.01)

(58) Field of Classification Search
CPC ..... F02M 7/12; F02M 7/06; F02M 17/04
(Continued)

(56) References Cited

U.S. PATENT DOCUMENTS 4,770,823 A * 9/1988 Sejimo ..... B60B 7/0086 236/101 E
5,194,186 A 3/1993 Edlund
(Continued)

FOREIGN PATENT DOCUMENTS

CN 201330657 Y 10/2009
JP 2001115895 4/2001

OTHER PUBLICATIONS

Written Opinion & International Search Report for PCT/US2015/017750 dated Jun. 8, 2015, 14 pages.

*Primary Examiner* — Robert A Hopkins
(74) *Attorney, Agent, or Firm* — Reising Ethington P.C.

(57) ABSTRACT

A carburetor may include a body having a main bore from which a fuel and air mixture is discharged for use by an engine, a throttle valve head, a choke valve head and a flow directing feature. The throttle valve head may be carried by the body and is moveable between an idle position and a wide open position to control at least some fluid flow through the main bore. The choke valve head may also be carried by the body and is moveable between a first position and a second position to at least in part control fluid flow through the main bore. And the flow directing feature associated with the choke valve head or the throttle valve head may alter at least one of the velocity or direction of at least a portion of the fluid that flows in the main bore.

22 Claims, 3 Drawing Sheets

(51) Int. Cl.

| | |
|---|---|
| ***F02D 9/10*** | (2006.01) |
| ***F02M 7/12*** | (2006.01) |
| ***F02M 7/06*** | (2006.01) |
| ***F02M 1/02*** | (2006.01) |
| ***F02M 17/04*** | (2006.01) |

(58) Field of Classification Search
USPC ..... 261/42, 38
See application file for complete search history.

(56) References Cited

U.S. PATENT DOCUMENTS

| | | | |
|---|---|---|---|
| 6,349,925 | B1 | 2/2002 | Tobinai et al. |
| 7,264,224 | B1 | 9/2007 | Weston |

* cited by examiner

CARBURETOR WITH SCAVENGING FLUID FLOW

REFERENCE TO CO-PENDING APPLICATIONS

This application claims the benefit of U.S. Provisional Application No. 61/946,458 filed Feb. 28, 2014, which is incorporated herein by reference in its entirety.

TECHNICAL FIELD

The present disclosure relates generally to a carburetor for providing a fuel and air mixture to an engine.

BACKGROUND

Carburetors are devices that can be used to mix fuel with air to power combustion engines. A carburetor may include a fuel metering system that helps control the amount of fuel supplied to air flowing through the carburetor to provide a desired fuel to air ratio of the fuel and air mixture delivered from the carburetor. The fuel may be delivered from the metering system into a main bore through which air flows and in which the fuel and air may become mixed. Control of the fluid flow into and through the carburetor is needed to provide a desired fluid output from the carburetor.

SUMMARY

A carburetor may include a body having a main bore from which a fuel and air mixture is discharged for use by an engine, a throttle valve head, a choke valve head and a flow directing feature. The throttle valve head may be carried by the body and is moveable between an idle position and a wide open position to control at least some fluid flow through the main bore. The choke valve head may also be carried by the body and is moveable between a first position and a second position to at least in part control fluid flow through the main bore. And the flow directing feature associated with the choke valve head or the throttle valve head may alter at least one of the velocity or direction of at least a portion of the fluid that flows in the main bore.

In one or more embodiments the flow directing feature may be defined by a non-planar portion of the choke valve head or the throttle valve head.

In one or more embodiments the flow directing feature includes a portion of the choke valve head that is angled relative to an adjacent portion of the choke valve head.

In one or more embodiments the flow directing feature is defined by one or more projections extending from the choke valve head, and the projections may define a channel through which air flows, and the channel may be arranged to alter the velocity of air flowing therein.

In one or more embodiments, when the throttle valve head is in its wide open position and the choke valve is in its second position, the main bore is substantially divided into two sections by the valve heads and the flow direction feature directs fluid flow toward one section and away from the other section.

In one or more embodiments two flow directing features are provided on the choke valve head and both flow directing features direct fluid toward one section and away from the other section.

In one or more embodiments a rich fuel and air mixture flows out of one section of the main bore and a fluid with less fuel flows out of the other section.

In one or more embodiments the flow directing feature includes a non-circular portion of the choke valve head that defines an enlarged portion of the choke valve head, and said non-circular portion is disposed adjacent to the throttle valve head when the choke valve is in its second position to reduce the size of one or more gaps between the choke valve head and throttle valve head within the main bore.

In one or more embodiments the angled portion of the choke valve head is provided at an upstream portion of the choke valve head, and in one or more embodiments the angled portion of the choke valve head is provided at an downstream portion of the choke valve head.

In one or more embodiments the carburetor includes a main fuel outlet through which fuel is discharged into the main bore and wherein the flow directing feature increases the velocity of air flow in the area of the main fuel outlet.

One or more embodiments also include a main fuel outlet through which fuel is discharged into the main bore and wherein the flow directing feature directs a portion of the air flowing in the main bore at the main fuel outlet.

In one or more embodiments the flow directing feature overlaps at least part of the main fuel outlet.

In one or more embodiments the flow directing feature includes an opening formed through either the choke valve head or throttle valve head.

In one or more embodiments the carburetor includes a fuel outlet and the opening is formed in the choke valve head and the opening is oriented to direct an air flow at the fuel outlet.

One or more embodiments may also include a gap between the choke valve head and the throttle valve head, and a main fuel outlet in said one section and through which fuel is discharged into the main bore, and wherein the flow directing feature causes at least some fluid in said other section to flow through the gap and into said one section.

In one or more embodiments the flow direction feature includes a portion of the choke valve head that is angled toward and at least partially into said one section.

In one or more embodiments a portion of the choke valve head overlaps a portion of the throttle valve head when the choke valve is in its second position to reduce the size of one or more gaps between the choke valve head and throttle valve head within the main bore.

In at least one implementations, a carburetor may include a body, a throttle valve head, a choke valve head and a flow directing feature. The body has a main bore from which a fuel and air mixture is discharged for use by an engine. The throttle valve head is carried by the body and moveable between an idle position and a wide open position to control at least some fluid flow through the main bore. The choke valve head is carried by the body and moveable between a first position and a second position to at least in part control fluid flow through the main bore. And the flow directing feature is associated with the choke valve or the throttle valve to alter at least one of the velocity or direction of at least a portion of the fluid that flows in the main bore. When the throttle valve head is in its wide open position and the choke valve is in its second position, the main bore is substantially divided into two sections by the valve heads and fluid flow between the two sections is controlled at least in part by the flow directing feature to provide a desired fluid flow through each of the two sections.

In one or more embodiments a first section of the two sections includes air and a second section of the two sections includes a fuel and air mixture. And in one or more embodiments the flow directing feature inhibits fuel flow from said second section into said first section.

Within the scope of this disclosure it is envisaged that the various aspects, embodiments, examples, features and alternatives set out in the preceding paragraphs, in the claims and/or in the following description and drawings may be taken independently or in any combination thereof. For example, features disclosed in connection with one embodiment are applicable to all embodiments, except where there is incompatibility of features.

BRIEF DESCRIPTION OF THE DRAWINGS

The following detailed description of preferred embodiments and best mode will be set forth with reference to the accompanying drawings, in which.

DETAILED DESCRIPTION

Figure 1:
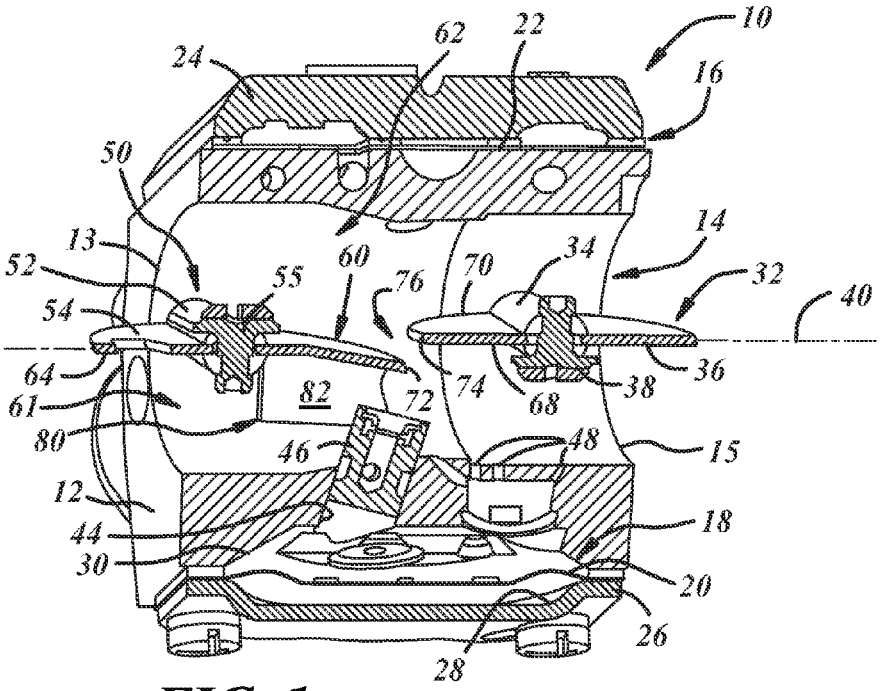
FIG. 1 is a cross-sectional view of a carburetor including a flow directing feature.
Figure 2:
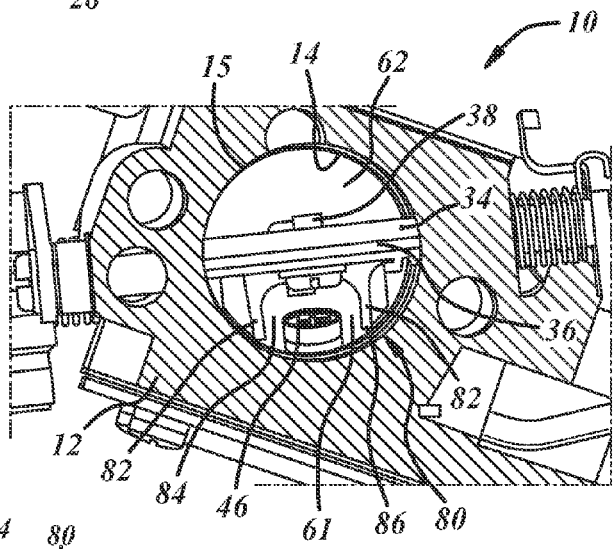
FIG. 2 is a fragmentary side view of the carburetor of FIG. 1.

Referring in more detail to the drawings, FIGS. 1-2 illustrate a carburetor 10 that provides a fuel and air mixture to an engine to support operation of the engine. The carburetor 10 has a main body 12 (typically cast metal) with a main bore 14 through which air flows from an inlet side 13, usually positioned adjacent to an air cleaner, to an outlet side 15, usually positioned adjacent to an engine intake. The carburetor 10 also has one or more fuel circuits through which fuel is provided into the main bore 14 and combined with the air flow to form the fuel and air mixture. The fuel circuit(s) include(s) a fuel pump assembly 16 and a fuel metering assembly 18. The fuel metering assembly 18 includes a diaphragm 20 that controls the rate at which fuel is delivered into the main bore 14 in accordance with a pressure differential across the metering diaphragm 20. The fuel pump assembly 16 includes a diaphragm 22 that is driven to take in fuel from a fuel source and discharge fuel to the fuel metering assembly 18.

The fuel pump assembly 16 may include a fuel pump body 24 that defines part of the fuel pump assembly, including fuel flow paths for the fuel pump assembly, and traps the fuel pump diaphragm 22 against the carburetor main body 12. The fuel metering assembly 18 may include a fuel metering body 26 that traps the fuel metering diaphragm 20 against the carburetor main body 12 and, with the fuel metering diaphragm 20, defines a reference chamber 28 that may be at atmospheric pressure due to a vent formed in the body 26. A fuel metering chamber 30 is defined on the opposite side of the fuel metering diaphragm 20 as the reference chamber 28 and fuel is provided to the main bore 14 from the fuel metering chamber 30 in normal operation of the carburetor 10 and engine. The general constructions and functions of the fuel pump assembly 16 and the fuel metering assembly 18 are known in the art and will not be described further.

The carburetor 10 may include a throttle valve 32 carried by the body 12 for adjusting the flow rate of the fuel and air mixture out of the carburetor 10. The throttle valve 32 includes a throttle shaft 34 and a throttle valve head 36 mounted, such as by a screw 38, to the throttle shaft 34. The throttle shaft 34 is rotatably carried by or relative to the body 12 and extends transversely across the main bore 14 to enable rotation of the throttle valve head 36 relative to the main bore. In at least some implementations, the throttle valve head 36 is defined by a flat disc commonly referred to as a butterfly valve head. The throttle valve 32 is rotated between an idle position and a wide open position, and may be operated at various positions in between those two positions. In the idle position, the throttle valve head 36 is substantially transverse to a centerline 40 of the main bore 14, and may be rotated between about 3 and 20 degrees from a plane that is transverse to the centerline 40. In this position, the throttle valve head 36 provides a maximum restriction to fluid flow out of the main bore 14, but allows sufficient fluid flow to support idle engine operation. In the wide open position of the throttle valve 32, shown in FIG. 1, the throttle valve head 36 typically is generally parallel to the centerline 40 of the main bore 14, and provides a minimum restriction to fluid flow out of the main bore and to the engine. The throttle valve head 36 is disposed adjacent to the outlet side 15 of the carburetor, and downstream of (at least when the throttle valve is in its idle position) a main fuel outlet 44.

The main fuel outlet 44 opens into the main bore 14 and is in communication with the fuel metering assembly 18 to enable fuel flow into the main bore 14. The main fuel outlet 44 may include a nozzle 46 which may be formed in the body 12 or defined by an insert assembled into the body. The main fuel outlet 44 may be located between the inlet and outlet sides 13, 15 of the main bore 14 and may be within a narrower portion of the main bore which acts as a venturi to increase flow velocity and decrease fluid pressure near the main fuel outlet 44. The main fuel outlet 44 primarily supplies fuel to the main bore when the throttle valve is opened sufficiently off idle, for example (without limitation), when the throttle valve is rotated at least 10 degrees from its idle position. At idle and lower speed/lower load engine operation, fuel is supplied into the main bore 14 primarily through low speed fuel ports 48 that open into the main bore and are also in communication with the fuel metering assembly 18. The low speed fuel ports 48 are located downstream of the main fuel outlet 44, in the area of the throttle valve head 36, and rotation of the throttle valve head 36 varies the pressure across the low speed ports 48 and the fuel flow therethrough.

The carburetor 10 also includes a choke valve 50 that is located upstream of the throttle valve 32 and generally adjacent to the inlet side 13 of the main bore 14. The choke valve 50 includes a choke shaft 52 and a choke valve head 54 disposed in or adjacent to the main bore 14 and mounted to the choke shaft 52, such as by a screw 55. The choke shaft 52 is rotatably carried by the body 12 and extends transversely across the main bore 14 to enable rotation of the choke valve head 54 relative to the main bore. The choke valve 50 is rotated from a first or closed position to a second or open position. In the first position of the choke valve 50, the choke valve head 54 mostly closes the main bore 14 and substantially inhibits air flow past the choke valve head. In the second position of the choke valve 50, the choke valve head 54 provides a minimal restriction to air flow into the main bore 14 and past the choke valve head. The choke valve 50 is in its second position during normal engine operation and generally is moved to its first position to facilitate starting the engine, as is known in the art. The choke valve head 54 may be at least partially defined by a generally flat disc, similar to the throttle valve head 36. To permit a desired amount of air flow through the main bore 14 when the choke valve 50 is in its first position the choke valve head 54 may include an opening 56 therethrough, and a second opening 58 (both shown in FIG. 3) may receive the fastener 55 holding the valve head 54 to the shaft 52.

Figure 3:
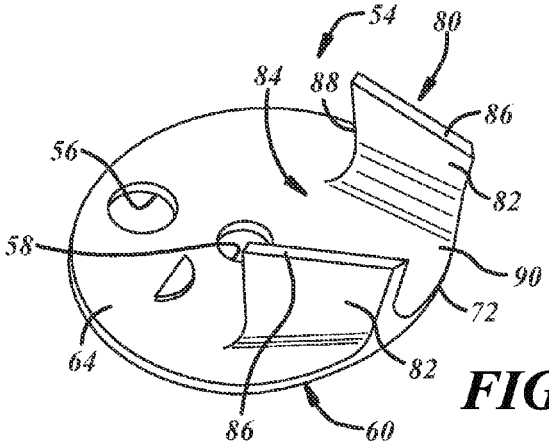
FIG. 3 is a perspective view of a choke valve head.

To aid in directing air flow in the area of the main fuel outlet 44, a flow directing feature may be associated with, such as by being carried by, at least a portion of the choke valve head 54. In the embodiment of FIGS. 1-3, one flow directing feature is implemented by a bent, curved or otherwise not planar portion 60 of the choke valve head 54. The non-planar portion 60 of the choke valve head 54 is provided in a downstream portion of the choke valve head and it is oriented so that it is angled toward the main fuel outlet when the choke valve 50 is in its second or open position. The non-planar portion 60 may be provided at an angle of between 1 and 170 degrees relative to the remainder of the choke valve head 54. Where an angle of 90 degrees is perpendicular to air flow, angles of 90 degrees or more may tend to cause turbulence and may be useful where increased mixing of fluid is desired (although such angles may be used for other reasons). Angles less than 90 degrees, and particularly less than 45 degrees, for example between 3 and 45 degrees, may more smoothly guide or direct fluid flow, in at least some implementations. The non-planar portion 60 may begin downstream of the choke valve shaft, if desired. Of course, the bent or angled non-planar portion 60 could be provided in any suitable location or orientation to direct/control air flow as desired, including at a different angle relative to the airflow and starting/ending at different locations along the choke valve head 54. Further, more than one area may be angled or offset relative to other portions of the choke valve head 54, and/or more than one bend may be provided.

The choke valve 50 may be located within the main bore 14 such that a portion of the choke valve head 54 overlaps at least a portion of the main fuel outlet 44 in at lea one direction. As shown, the non-planar portion 60 of the choke valve head 54 overlaps in the axial direction (e.g. direction of fluid flow between the inlet and outlet side of the carburetor) at least a portion of the main fuel outlet 44 so that fluid (e.g. air) is directed toward the main fuel outlet and a reducing or decreasing flow area within the main bore 14 is provided in the area of the main fuel outlet 44. This reduced flow area tends to increase the velocity of air flow in that portion of the main bore 14 which decreases the pressure in the area of the main fuel outlet 44 and can increase fuel flow from the main fuel outlet.

Also, as shown in FIG. 1, when the choke valve 50 is in its second position, the choke valve head 54 substantially divides the main bore into two sections 61, 62. A first section 61 is directly open to the main fuel outlet 44 and adjacent to a first side 64 of the choke valve head 54, and a second section 62 is spaced and generally separate from the main fuel outlet 44 and adjacent to an opposite, second side 66 of the head 54. The throttle valve head 36 likewise has first and second sides 68, 70 that are generally aligned with the sides 64, 66 of the choke valve head 54 when the choke valve 50 is in its second position and the throttle valve 32 is in its wide open position, as shown in FIG. 1. In this position, the valve heads 36, 54 provide a substantially continuous division of the main bore 14 from its inlet end 13 to its outlet end 15.

Thus, air flowing into the main bore inlet 13 when the choke valve is in its open position is divided into two streams, by the choke valve head 54. A first fluid stream flows into the first section 61 of the main bore 14 adjacent to the first side 64 of the choke valve head 54 and is directly communicated with the main fuel outlet 44. This first fluid stream is mixed with fuel discharged into the main bore 14 from the main fuel outlet 44. A second fluid stream flows into the second section 62 of the main bore 14 adjacent to the opposite, second side 66 of the choke valve head 54 and is not directly communicated with the main fuel outlet 44. A lesser amount of fuel is mixed with the second fluid stream, up to and including no fuel.

Accordingly, the carburetor may provide a stratified fluid discharge with a lean fluid stream including primarily or only air and a rich fluid stream including a mixture of fuel and air. These streams may be maintained separate from each other downstream of the carburetor by suitable dividers carried by or in the engine intake, if desired. The second stream may, for example, provide a scavenging air supply used to displace exhaust gases from an engine combustion chamber and replace the exhaust gases with a fresh charge of primarily or only air. The first stream provides a richer fuel and air mixture to support combustion in the engine. In addition to increasing flow velocity near the main fuel outlet 44, the non-planar portion 60 of the choke valve head 54 can also direct the air flow in the first section 61 away from the second section 62 to maintain and even promote separation of the fluid streams. Thus, it is less likely that a portion of the fluid in the first stream will migrate to and mix with fluid in the second stream in a cross-over region between the choke valve head and throttle valve head. In this regard, the non-planar portion of the choke valve head may extend to the downstream edge 72 of the choke valve head 54 which may be offset from and not co-planar with an upstream edge 74 of the throttle valve head 36 when both valves 32, 50 are fully open. A gap 76 defined between the valve heads 36, 54 may be oriented away from the second section 62 of the main bore 14 and in the direction of the first section 61 and the main fact outlet 44. Hence, a portion of the air stream in the second section 62 may flow through the gap 76 between the valve heals 36, 54 and mix with the fluid in the first section 61. This also inhibits migration of the fluid in the first section 61 into the second section 62 to reduce or prevent fuel flow into the second section 62.

In addition o or instead of the non-planar portion 60 of the choke valve head 54, a second flow directing feature 80 may be provided in the area of the main fuel outlet 44. This flow directing feature 80 is separate from the carburetor body (e.g. not a restriction formed in the main bore 14) and any nozzle 46 in the main fuel outlet 44 and is arranged to direct and control air flow in the area of the main fuel outlet. In the implementation shown in FIGS. 1-3, the flow directing feature 80 includes one or more projections 82 carried by the choke valve head 54 and defining a further non-planar portion of the valve head 54. The projections 82 may be formed integrally in the same piece of material that defines the remainder of the choke valve head 54, or they may be separate components that are each attached to or otherwise carried by the choke valve head 54, or they may be connected together within a separate component that is attached to the choke valve head 54.

As shown, the projections 82 extend outwardly from the first side 64 of the choke valve head 54 and define a channel 84 between them. In this implementation, the projections 82 are cantilevered on the valve head 54 and are not connected together such that each projection 82 has a free end 86 and the channel 84 is not enclosed. If desired, the projections could be joined together by a spanning wall to define an enclosed channel of any desired shape. Further, while the projections 82 are shown as generally straight or planar, they could be curved or bent in any desired shape and of any desired size, spacing and orientation.

As shown in FIG. 3, the channel 84 includes an inlet end 88 upstream of an outlet end 90, and the inlet and outlet ends are generally aligned with regard to the direction of fluid flow in the main bore 14. The distance between the projections 82 is less at the outlet end 90 than the inlet end 88 (i.e. the projections converge toward the outlet end) so the channel narrows from the inlet end 88 to the outlet end 90. Because of this, air flowing through the channel 84 tends to increase in velocity from the inlet end 88 to the outlet end 90, and air is further directed by the channel 84 toward the main fuel outlet 44. Thus, in this example, both the non-planar portion 60 of the choke valve 54 and the projections 82 tend to increase the velocity of at least some of the fluid in the first section 61 of the main bore 14, and direct some of that fluid stream toward the main fuel outlet 44 and away from the second section 62.

When used with a valve head 54 having a non-planar portion 60, at least part of the projections 82 may extend along at least a portion of the non-planar portion 60 of the valve head 54. Thus, both flow directing features 60, 80 work together in promoting a desired air flow through at least part of the main bore 114. As best shown in FIGS. 1 and 2, the projections 82 may extend away from the first side 64 of the choke valve head 54 and may overlap at least a portion of a nozzle 46 in the main fuel outlet 44 when the choke valve 50 is in its second position. In this position, the projections 82 overlap the nozzle both in a direction perpendicular to the centerline or axis of the main bore (vertically, in the carburetor orientation shown in the drawings) and in a direction parallel to the centerline (horizontally, in the carburetor orientation shown in the drawings). Hence, the increased velocity air stream through the channel 84 is directed close to the main fuel outlet 44 and may have its maximum velocity at or near the nozzle 46 to provide a greater pressure drop across the nozzle and improved control of fuel flow after the fuel exits the nozzle.

While shown as directing air flow toward the main fuel outlet 44, a flow directing feature may be used elsewhere in the carburetor 10. For example, the second side 66 of the choke valve head 54 could include a flow directing feature to direct the fluid stream in the second section 62 of the main bore 14 as desired. As just one example, fluid in the second section 62 could be directed away from the first section 61. Further, while the offset or angled non-planar portion 60 of the choke valve head 54 is defined by a bend in the choke valve head 54, it could be implemented in a thicker portion of the choke valve head. The second side 66 of the choke valve head 54 could be planar (e.g. not include a bend) or even include an angled or ramped surface directed away from the first section 61 of the main bore 14. The choke valve head 54 may be formed from any suitable material, such as various metals and plastics, with all features formed in one, integral piece of material, or from multiple pieces of material.

Figure 4:
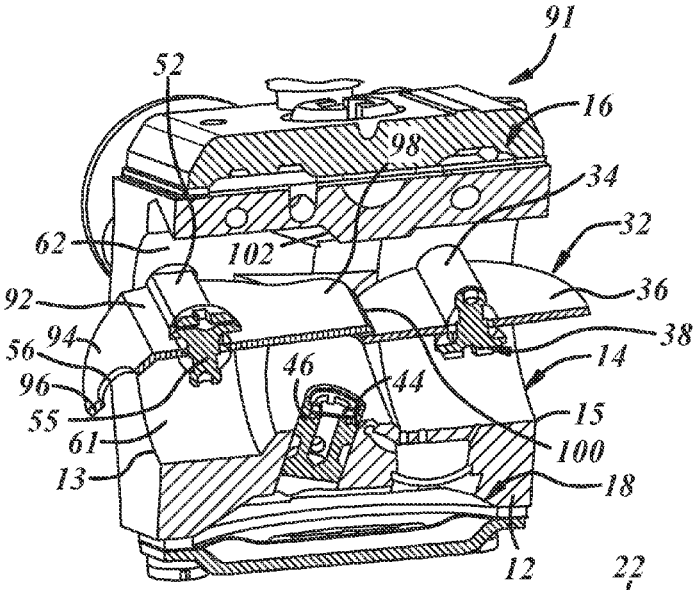
FIG. 4 is a cross-sectional view of a carburetor including a different choke valve head.
Figure 5:
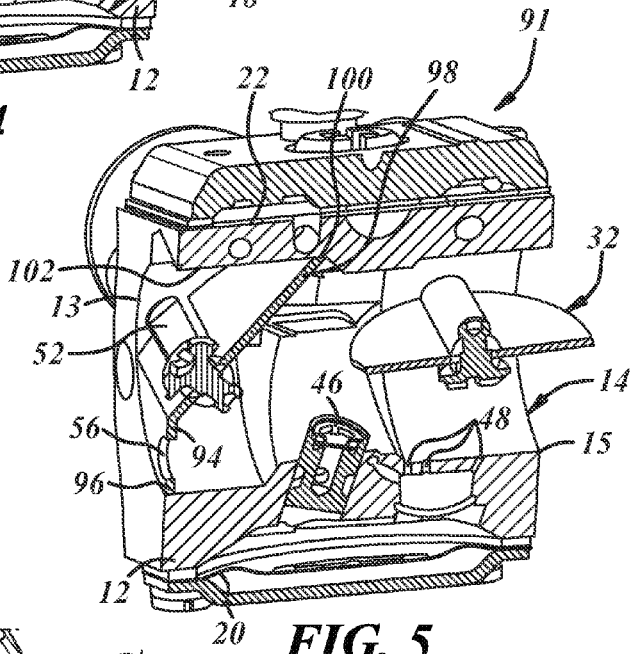
FIG. 5 is a cross-sectional view of the carburetor of FIG. 5 showing the choke valve is a first position.
Figure 6:
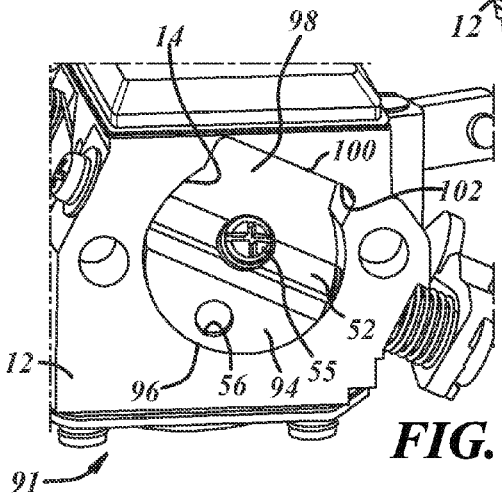
FIG. 6 is a fragmentary end view of the carburetor.

In the implementation of FIGS. 4-6, the carburetor 91 may be of the same general construction as the carburetor 10, and the same reference numbers are used to facilitate disclosure of the same or similar components and features. The carburetor 91 includes a choke valve head 92 that includes a flow directing feature implemented as a non-planar portion 94 at an upstream edge 96 of the choke valve head 92, adjacent to the inlet 13 of the main bore 14. As shown, the choke valve head 92 includes a portion that is angled toward the first section 61 of the main bore 14 and away from the second section 62. This tends to reduce the effective flow area of the inlet portion of the first section 61 and increase air velocity in that region. It may also tend to direct a greater volume of air through the second section 62 of the main bore 14.

Further, the choke valve head 92 includes an opening 56 through which air flows when the choke valve is closed, as shown in FIG. 5, and as described with reference to the choke valve head 54 of carburetor 10. However, in this implementation, the opening 56 is provided in the non-planar portion 94 and when the choke valve is in its second or open position, as shown in FIG. 4, air flows through the opening 56 in the choke valve head 92. And the opening may be oriented or positioned as desired. In the implementation shown, the air flow through the opening 56 is aligned with or aimed in the area of the outlet of the nozzle 46 and directs an air flow at or toward the nozzle. Among other things, this may promote flow out of the nozzle 46, mixing of the fuel and air, and also help maintain fuel in the first section 61 of the main bore 14. The opening 56 may also be considered a flow directing feature and may advantageously promote a desired fluid flow in the main bore 14.

In addition to the non-planar portion 94, a noncircular flow directing feature 98 may be carried by or formed in the choke valve head 92. The noncircular feature 98 may extend outwardly from a main portion of the valve head 92 to provide an increased surface area at the downstream end 100 of the choke valve head 92 than the choke valve head 92 would have if it were circular. At least a portion of the noncircular feature 98 may overlap a portion of the throttle valve head 36 when the choke valve head 92 is in its second position and the throttle valve is in its wide open position, as shown in FIG. 4. The increased surface area provided by the noncircular feature 98 and the overlapping of the valve heads 36, 92 reduces gaps between the valve heads 36, 92 and/or between the heads and main bore 14 to promote separation between the fluid streams in the first and second sections 61, 62 of the main bore 14. The noncircular feature 98 may be any suitable shape for use in or adjacent to the main bore and is shown as being generally rectangular. The carburetor body 12 may include a recess 102 open to the main bore 14 and complementary in shape to the noncircular feature 98, in any area of the main bore where such extra clearance may be needed due to the increased surface area provided by the noncircular feature 98.

A choke valve head 54, 92 may be mounted off-center relative to the main bore 14 such that one of the two sections 61, 62 is larger than the other, as desired. Further, a choke valve head 54, 92 may be provided with any one of, or any combination of, the various flow directing features described herein as well as modified flow directing features that persons of ordinary skill in the art will readily devise in view of the teachings herein. In other words, these features may be used separately or in any desired combination. Further, while various features were described that increase fluid flow velocity, flow directing features could also be provided that decrease a fluid flow velocity. Likewise, while certain features were described as promoting separation of two fluid flows, flow directing features like those disclosed herein could also be implemented to encourage mixing of fluid within the carburetor. Still further, the features discussed herein, separately or in any combination, could also be implemented on or associated with the throttle valve. By way of examples, without limitation, this may be useful to control mixing of fuel with air in the first section of the main bore and/or to control the outlet of the fluid streams from the first and two sections toward/into the engine. And the flow directing features can be used with both of the choke and throttle valves in the same carburetor.

Figure 7A:
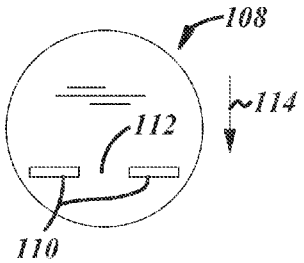
FIG. 7A is a plan view and FIG. 7B is an end view of a butterfly type valve with at least one flow directing feature.
Figure 8A:
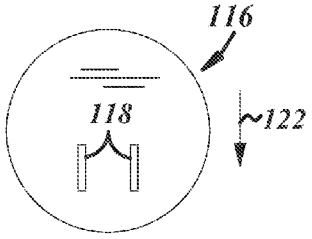
FIG. 8A is a plan view and FIG. 8B is an end view of a butterfly type valve with at least one flow directing feature.
Figure 9A:
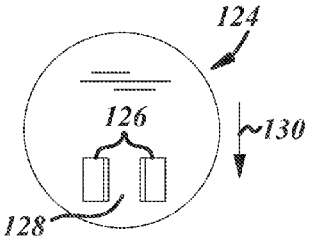
FIG. 9A is a plan view and FIG. 9B is an end view of a butterfly type valve with at least one flow directing feature.
Figure 7B:
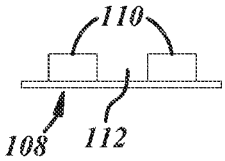
Figure 8B:
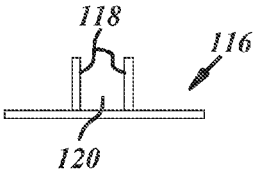
Figure 9B:
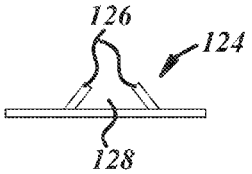

Various implementations of flow directing features that may be implemented on either or both of the choke valve head and throttle valve head are shown in FIGS. 7A-12B. FIGS. 7A and 7B somewhat diagrammatically show a valve head 108 having projections 110 that are parallel and extend outwardly from the valve head to define a passage or gap 112 between them, with a direction of air flow shown by the arrow 114. FIGS. 8A and 8B somewhat diagrammatically show a valve head 116 having projections 118 that are parallel and extend outwardly from the valve head to define a passage or gap 120 between them with a direction of air flow shown by the arrow 122. FIGS. 9A and 9B somewhat diagrammatically show a valve head 124 having projections 126 that are inclined inwardly toward each other as shown in FIG. 9B and extend outwardly from the valve head to define a passage or gap 128 between them with a direction of air flow shown by the arrow 130. The projections 126 could instead be angled away from each other, and may be oriented at any angle. The projections 110, 118 and 126 are shown as cantilevered with their free ends separate and not connected, but the projections on a valve could be connected together, as previously noted.

Figure 10A:
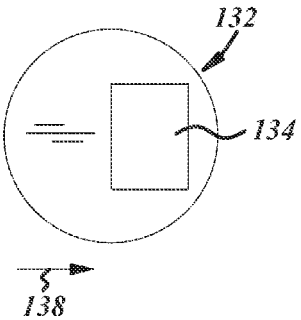
FIG. 10A is a plan view and FIG. 10B is an end view of a butterfly type valve with at least one flow directing feature.
Figure 11A:
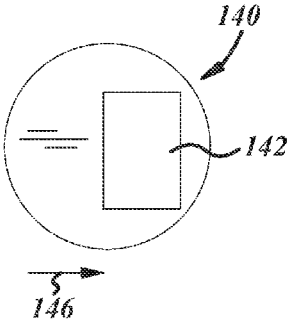
FIG. 11A is a plan view and FIG. 11B is an end view of a butterfly type valve with at least one flow directing feature.
Figure 12A:
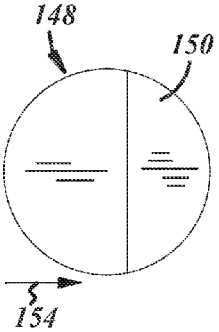
FIG. 12A is a plan view and FIG. 12B is an end view of a butterfly type valve with at least one flow directing feature.
Figure 10B:
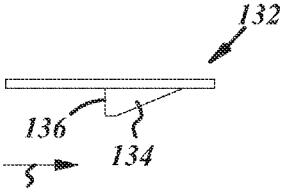
Figure 11B:
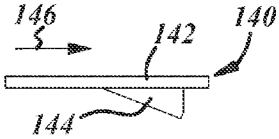
Figure 12B:
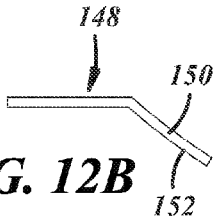

FIGS. 10A and 10B somewhat diagrammatically show a valve head 132 having a projection or non-planar portion 134 that extends outwardly from the valve head and provides a surface 136 that generally confronts air flow, where the direction of air flow is shown by the arrow 138. While surface 136 is shown as being generally perpendicular to the air flow, the surface 136 could be at any desired angle. FIGS. 11A and 11B somewhat diagrammatically show a valve head 140 having a projection or non-planar portion 142 that extends outwardly from the valve head and provides a ramped surface 144 that more smoothly guides air flow compared to the valve head 132, where the direction of air flow is shown by the arrow 146. The surface 144 could be at any desired angle. FIGS. 12A and 12B somewhat diagrammatically show a valve head 148 having a non-planar portion 150 that extends outwardly from the valve head and provides a surface 152 that directs airflow away from the valve head, where the direction of air flow is shown by the arrow 154.

While representative shapes have been shown in these figures, many more are possible and the illustrated implementations are not intended to limit the scope of the disclosure in any way. Further, the valve heads shown herein can be oriented in different ways/directions relative to the direction of air flow and need not be in the orientations shown in the drawings.

While the forms of the invention herein disclosed constitute presently preferred embodiments, many others are possible. For example, the flow directing features can have other shapes, orientations, locations and functions as would be appreciated by persons of ordinary skill in this art in view of this disclosure. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A carburetor, comprising:

a body having a main bore from which a fuel and air mixture is discharged for use by an engine;

a throttle valve head carried by the body and moveable between an idle position and a wide open position to control at least some fluid flow through the main bore;

a choke valve head carried by the body and moveable between a first position and a second position to at least in part control fluid flow through the main bore; and a flow directing feature associated with the choke valve or the throttle valve to alter at least one of the velocity or direction of at least a portion of the fluid that flows in the main bore, wherein the flow directing feature is defined by one or more projections, the projections define a channel through which air flows, and the channel includes an outlet end and an inlet end upstream of the outlet end and the inlet and outlet ends are aligned with regard to the direction of fluid flow in the main bore.

2. The carburetor of claim 1 wherein another flow directing feature is defined by a non-planar portion of the choke valve head or the throttle valve head.

3. The carburetor of claim 2 wherein said another flow directing feature includes a portion of the choke valve head that is angled relative to an adjacent portion of the choke valve head.

4. The carburetor of claim 1 which also includes a fuel outlet open to the main bore and through which fuel flows into the main bore, and wherein the projections are carried by the choke valve head and the projections are oriented so that fluid flow through the channel is directed toward the main fuel outlet.

5. The carburetor of claim 4 wherein the projections overlap a portion of the main fuel outlet when the choke valve is in the second position.

6. The carburetor of claim 1 wherein, when the throttle valve head is in its wide open position and the choke valve is in its second position, the main bore is substantially divided into two sections by the valve heads and the flow direction feature directs fluid flow toward one section and away from the other section.

7. The carburetor of claim 6 wherein two flow directing features are provided on the choke valve head and both flow directing features direct fluid toward one section and away from the other section.

8. The carburetor of claim 6 wherein a rich fuel and air mixture flows out of one section of the main bore and a fluid with less fuel flows out of the other section.

9. The carburetor of claim 3 wherein the angled portion of the choke valve head is provided at an upstream portion of the choke valve head.

10. The carburetor of claim 3 wherein the angled portion of the choke valve head is provided at an downstream portion of the choke valve head.

11. The carburetor of claim 1 which also includes a main fuel outlet through which fuel is discharged into the main bore and wherein the flow directing feature increases the velocity of air flow in the area of the main fuel outlet.

12. The carburetor of claim 1 which also includes a main fuel outlet through which fuel is discharged into the main bore and wherein the flow directing feature directs a portion of the air flowing in the main bore at the main fuel outlet.

13. The carburetor of claim 11 wherein the flow directing feature overlaps at least part of the main fuel outlet in a direction parallel to a centerline of the main bore.

14. The carburetor of claim 1 which also includes a fuel outlet open to the main bore and through which fuel flows into the main bore wherein the choke valve overlaps the main fuel outlet in a direction parallel to a centerline of the main bore and wherein the projections alter the velocity of fluid flow at the fuel outlet.

15. The carburetor of claim 14 wherein the channel narrows from the inlet end to the outlet end so that air flowing through the channel increases in velocity from the inlet end to the outlet end.

16. The carburetor of claim 6 which also includes a gap between the choke valve head and the throttle valve head, and a main fuel outlet in said one section and through which fuel is discharged into the main bore, and wherein the flow directing feature causes at least some fluid in said other section to flow through the gap and into said one section.

17. The carburetor of claim 16 wherein the flow direction feature includes a portion of the choke valve head that is angled toward and at least partially into said one section.

18. A carburetor, comprising:

a body having a main bore from which a fuel and air mixture is discharged for use by an engine;

a throttle valve head carried by the body and moveable between an idle position and a wide open position to control at least some fluid flow through the main bore;

a choke valve head carried by the body and moveable between a first position and a second position to at least in part control fluid flow through the main bore; and a flow directing feature associated with the choke valve or the throttle valve to alter at least one of the velocity or direction of at least a portion of the fluid that flows in the main bore, wherein the flow directing feature includes a non-circular portion of the choke valve head that defines an enlarged portion of the choke valve head, and said non-circular portion is disposed adjacent to the throttle valve head when the choke valve is in its second position to reduce the size of one or more gaps between the choke valve head and throttle valve head within the main bore.

19. The carburetor of claim 18 wherein a portion of the choke valve head overlaps a portion of the throttle valve head when the choke valve is in its second position to reduce the size of one or more gaps between the choke valve head and throttle valve head within the main bore.

20. A carburetor, comprising:

a body having a main bore from which a fuel and air mixture is discharged for use by an engine and a fuel outlet open to the main bore and through which fuel flows into the main bore;

a throttle valve head carried by the body and moveable between an idle position and a wide open position to control at least some fluid flow through the main bore;

a choke valve head carried by the body and moveable between a first position and a second position to at least in part control fluid flow through the main bore; and a flow directing feature associated with the choke valve or the throttle valve to alter at least one of the velocity or direction of at least a portion of the fluid that flows in the main bore, when the throttle valve head is in its wide open position and the choke valve is in its second position, the main bore is substantially divided into a first section and a second section by the valve heads and fluid flow between the two sections is controlled at least in part by the flow directing feature to provide a desired fluid flow through each of the two sections wherein the first section is defined in part by a first side of the choke valve head and a first side of the throttle valve head and the first section is directly communicated with the fuel outlet, and the second section is defined in part by a second side of the choke valve head and a second side of the throttle valve head and the second section is not directly communicated with the fuel outlet, and wherein the flow directing feature is angled to permit fluid in the second section to flow into the first section and to inhibit fluid in the first section from flowing into the second section.

21. The carburetor of claim 20 wherein, when the choke valve is in its second position and the throttle valve is in the wide open position, a portion of the choke valve head overlaps a portion of the throttle valve head in a direction parallel to a centerline of the main bore.

22. The carburetor of claim 21 wherein the flow directing feature includes a non-planar portion of the choke valve head that extends to a downstream edge of the choke valve head, the downstream edge being not co-planar with an upstream edge of the throttle valve head when the choke valve is in the second position and the throttle valve is in the wide open positions so that a gap defined between the choke valve head and throttle valve head is oriented away from the second section and toward the first section.

* * * * *